US005664944A

United States Patent [19]

Watson et al.

[11] Patent Number: 5,664,944

[45] Date of Patent: Sep. 9, 1997

[54] LOW PRESSURE DROP VANES FOR BURNERS AND $NO_x$ PORTS

[75] Inventors: George B. Watson, Alliance; Woodrow A. Fiveland, Jackson Township, both of Ohio

[73] Assignee: The Babcock & Wilcox Company, New Orleans, La.

[21] Appl. No.: 749,883

[22] Filed: Nov. 15, 1996

Related U.S. Application Data

[63] Continuation of Ser. No. 349,758, Dec. 5, 1994, abandoned.

[51] Int. Cl.[6] ..... F23M 9/00

[52] U.S. Cl. ..... 431/183; 431/184; 416/231 R

[58] Field of Search ..... 431/181–185, 431/188; 239/402.5, 403, 405, 406; 416/231 R, 231 B; 415/115

[56] References Cited

U.S. PATENT DOCUMENTS

| | | | |
|---|---|---|---|
| 991,134 | 5/1911 | Capell | 416/231 B |
| 1,066,988 | 7/1913 | Boutwell | 416/231 R |
| 1,910,893 | 5/1933 | Frisch | 431/185 |
| 2,380,463 | 7/1945 | Poole | 110/104 |
| 2,414,459 | 1/1947 | Fletcher | 158/1.5 |
| 2,669,296 | 4/1954 | Stillman et al. | 158/1.5 |
| 2,676,649 | 4/1954 | Diehl et al. | 158/76 |
| 2,747,657 | 5/1956 | Harvey et al. | 158/73 |
| 2,782,738 | 2/1957 | Zoller | 110/28 |
| 3,049,085 | 8/1962 | Musat et al. | 110/28 |
| 3,179,152 | 4/1965 | Musat et al. | 158/11 |
| 3,198,235 | 8/1965 | Maskell | 158/1.5 |
| 3,299,841 | 1/1967 | Hemker et al. | 110/28 |
| 3,349,826 | 10/1967 | Poole et al. | 158/11 |
| 3,356,122 | 12/1967 | Rackley et al. | 158/1.5 |
| 3,664,757 | 5/1972 | Salisbury et al. | 416/231 R |
| 3,720,495 | 3/1973 | Zink et al. | 431/184 |
| 3,904,349 | 9/1975 | Peterson et al. | 431/184 |
| 4,106,890 | 8/1978 | Fulmer et al. | 431/184 |
| 4,160,640 | 7/1979 | Maev et al. | 431/9 |
| 4,479,775 | 10/1984 | Wiesel | 431/353 |
| 4,500,282 | 2/1985 | Eschenko et al. | 431/184 |
| 4,504,217 | 3/1985 | Winschel et al. | 431/183 |
| 4,519,322 | 5/1985 | Lindstrom et al. | 110/264 |
| 4,681,532 | 7/1987 | Chung | 431/183 |
| 4,927,352 | 5/1990 | Chung | 431/184 |
| 5,092,762 | 3/1992 | Yang | 431/184 |
| 5,101,633 | 4/1992 | Keller et al. | 60/737 |
| 5,112,220 | 5/1992 | Wimberger et al. | 432/8 |
| 5,142,858 | 9/1992 | Ciokajlo et al. | 60/39.33 |
| 5,145,361 | 9/1992 | Kurzinski | 431/19 |
| 5,199,355 | 4/1993 | Larue | 110/261 |
| 5,207,008 | 5/1993 | Wimberger et al. | 34/23 |
| 5,240,404 | 8/1993 | Hemsath et al. | 431/9 |
| 5,257,927 | 11/1993 | Lang | 431/184 |
| 5,302,115 | 4/1994 | Hagar et al. | 431/183 |

FOREIGN PATENT DOCUMENTS

| | | | |
|---|---|---|---|
| 364943 | 4/1906 | France | 416/231 R |
| 123905 | 10/1976 | Japan | 416/231 R |
| 754055 | 8/1956 | United Kingdom | 416/231 R |
| 942648 | 11/1963 | United Kingdom | 416/231 R |

*Primary Examiner*—James C. Yeung

*Attorney, Agent, or Firm*—Robert J. Edwards; Eric Marich

[57] ABSTRACT

A vane assembly defining a flow passage for gas moving in a flow direction has at least one spin vane in the flow passage, positionable at an angle with respect to the flow direction. The vane is made of-sheet material and has a leading portion which is perforated. This reduces pressure drop across the vane while still maintaining spin of the gas.

17 Claims, 6 Drawing Sheets

LOW PRESSURE DROP VANES FOR BURNERS AND $NO_X$ PORTS

This is a continuation of application Ser. No. 08/349,758 filed Dec. 5, 1994, abandoned.

FIELD AND BACKGROUND OF THE INVENTION

The present invention relates, in general, to the construction of spin vanes for directing gases through a passage and, in particular, to a new and useful low pressure drop vane for burners and $NO_x$ ports.

A key feature of burners and $NO_x$ ports used in industrial and utility boilers is the spin vanes in the secondary (or combustion) air zones. These spin vanes are used to change the flow direction of the incoming air to impart a swirl to the air as it exits the burner. The spin vanes are located in the annular flow passage(s) that surround the burner fuel nozzle or the core air flow passage in the $NO_x$ port. The spin vanes are fabricated from flat sheet material and are designed to be adjusted from a completely closed, to a fully open position in the annular flow passage.

Approximately one-half of the pressure drop across these burners and $NO_x$ ports is generated in the spin vane passage.

The pressure drop across the spin vanes becomes particularly important for low-$NO_x$ pulverized-coal burners if secondary air velocity has to increased from 4,500 to 6,500 feet per minute. The spin vane design needs to be improved to reduce pressure drop while maintaining swirl performance.

U.S. Pat. No. 5,257,927 discloses a low $NO_x$ burner using a central spin vane diffuser while U.S. Pat. No. 5,199,355 utilizes spin vane diffusers in concentric outer combustion passages. A compact flame holder combustor is also disclosed in U.S. Pat. No. 5,142,858. A boiler furnace register with vanes is disclosed in U.S. Pat. No. 4,927,352.

Various other patents disclose a variety of gas flow passages and registers, ports, burners, blowers and the like, which use various vane configurations. As with the patents mentioned above, the vanes are all solid and are characterized by causing a certain pressure drop in the gas flow. The additional patents are as follows:

| U.S. patents | U.S. patents |
|---|---|
| 5,302,115 | 3,720,495 |
| 5,207,008 | 3,356,122 |
| 5,145,361 | 3,349,826 |
| 5,112,220 | 3,299,841 |
| 5,101,633 | 3,198,235 |
| 5,092,762 | 3,179,152 |
| 4,681,532 | 3,049,085 |
| 4,519,322 | 2,782,738 |
| 4,504,217 | 2,747,657 |
| 4,500,282 | 2,676,649 |
| 4,479,775 | 2,669,296 |
| 4,160,640 | 2,414,459 |
| 4,106,890 | 2,380,463 |
| 3,904,349 | 1,910,893. |

It would thus be advantageous if a construction or a technique could be found which takes advantage of vanes, in particular, spin vanes, in a gas flow passage, while reducing the pressure drop caused by such vanes.

SUMMARY OF THE INVENTION

The present invention involves the addition of perforations into the leading section of spin vanes used in the air flow passages of burners, $NO_x$ ports, or any other gas flow passage.

The problem solved by the invention is the reduction in the flow recirculation zone that occurs on the back side of the spin vanes when they are rotated at an angle to the flow direction. A reduction in the recirculation zone results in a pressure drop reduction. Test results show a pressure drop reduction of 15% can be achieved, thus increasing efficiency.

The holes in the leading section of the spin vane allow flow to pass through the vane into the recirculation zone. This is a form of boundary layer control to more streamline the vane by altering the negative pressure gradient at the surface of the vane.

The inherent advantages of the perforated spin vanes over the standard spin vanes are:

- The pressure drop across the perforated spin vane is lower than that for the standard spin vane without perforations.
- The perforated spin vane has the same shape as the standard spin vane but with only the addition of perforations.
- Flat sheet material is used for fabrication.
- No bending or forming is necessary as would be required if the spin vane was aerodynamically shaped.
- The pressure drop reduction should be independent of the spin vane position (or angle of attack).

Alternatives to the use of holes can be vertical or horizontal slots added to the leading section of the spin vane. The slots may also be positioned at any orientation inbetween vertical and horizontal. The slots can also be die punched from the back side of the spin vane and the material bent forward to form a flow guide on the front side of the spin vane.

Accordingly, one aspect of the present invention is drawn to a vane assembly comprising: means defining a flow passage for gas moving in a flow direction; and at least one vane in the flow passage positionable at an angle to the flow direction, the vane being made of sheet material and having a leading portion which is perforated.

Another aspect of the invention is drawn to a vane for positioning at an angle to a flow direction in a flow passage, the vane comprising a sheet material member having a leading section in the flow direction which is perforated.

Yet still another aspect of the invention is drawn to a burner arrangement having means defining a flow passage for combustion gas moving in a flow direction; means for supplying a fuel for burning with the combustion gas and at least one vane in the flow passage positionable at an angle to the flow direction, the vane having a leading section with respect to the flow direction which is perforated.

A still further aspect of the invention is drawn to a vane assembly which can be used in a boiler or port or in general, within any flow passage, which significantly reduces pressure drop, while at the same time being simple in design, rugged in construction and economical to manufacture.

The various features of novelty which characterize the invention are pointed out with particularity in the claims annexed to and forming a part of this disclosure. For a better understanding of the invention, its operating advantages and specific results attained by its uses, reference is made to the accompanying drawings and descriptive matter in which preferred embodiments of the invention are illustrated.

DESCRIPTION OF THE PREFERRED EMBODIMENTS

Figure 3:
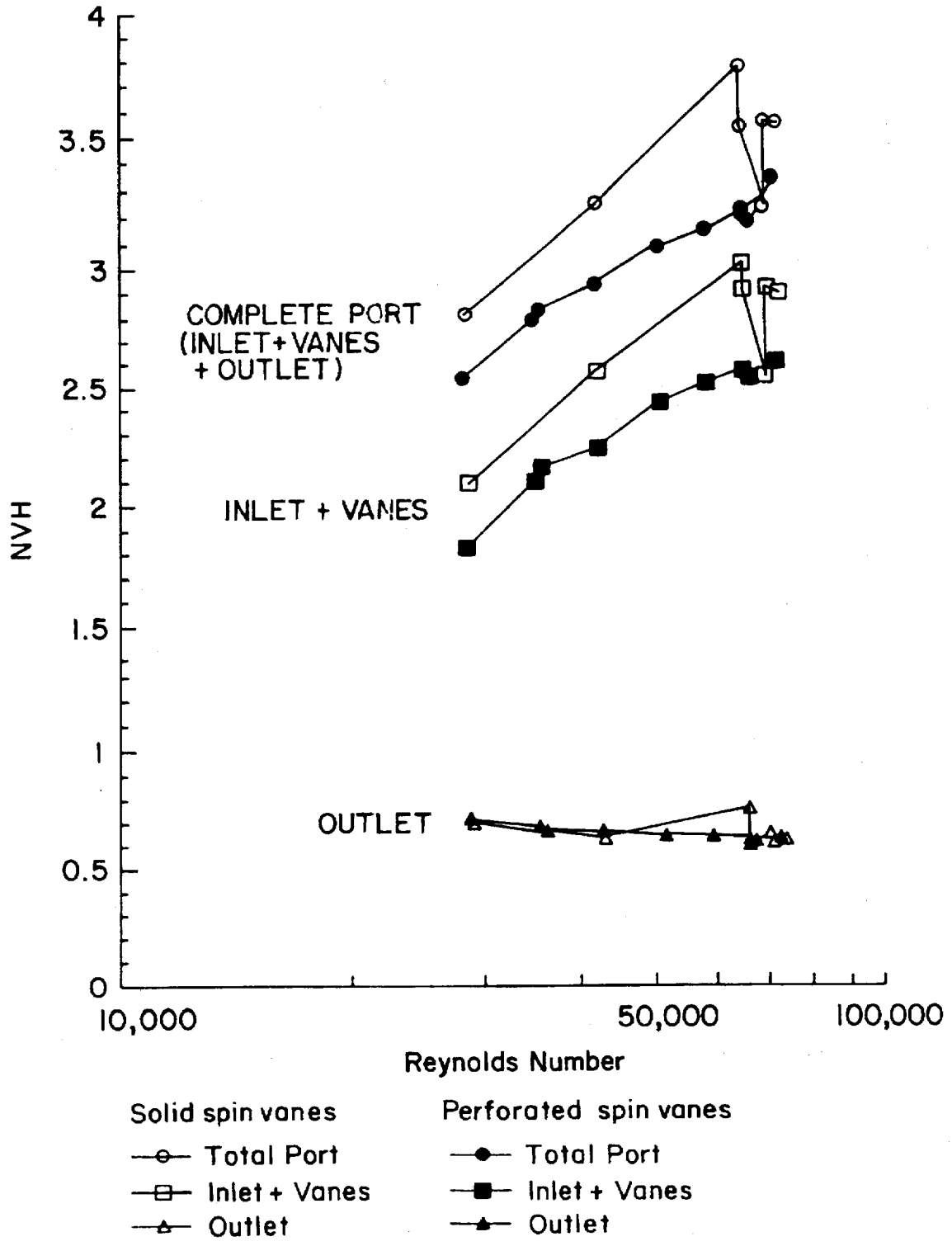
FIG. 3 is a graph plotting the number of velocity heads (NVH) against Reynolds number, Re, illustrating the results of actual experiments conducted on a ⅙ scale test facility.
Figure 4:
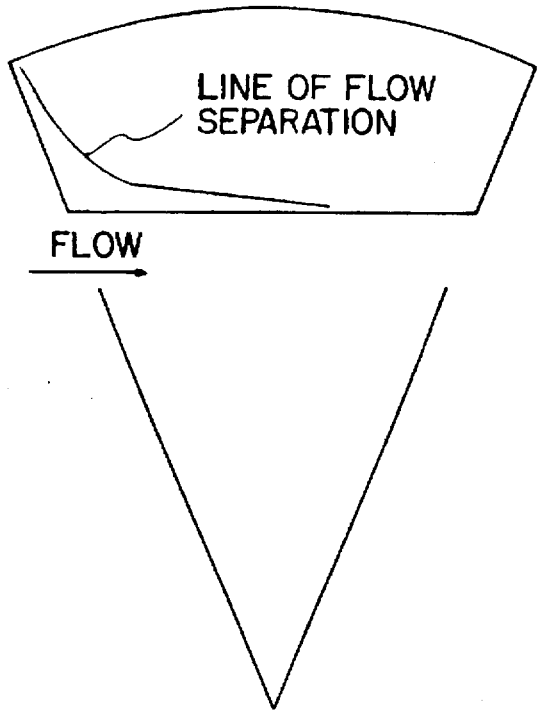
FIG. 4 PRIOR ART
FIG. 4 is a plan view with dimensions and characteristics of a conventional solid spin vane.
Figure 5:
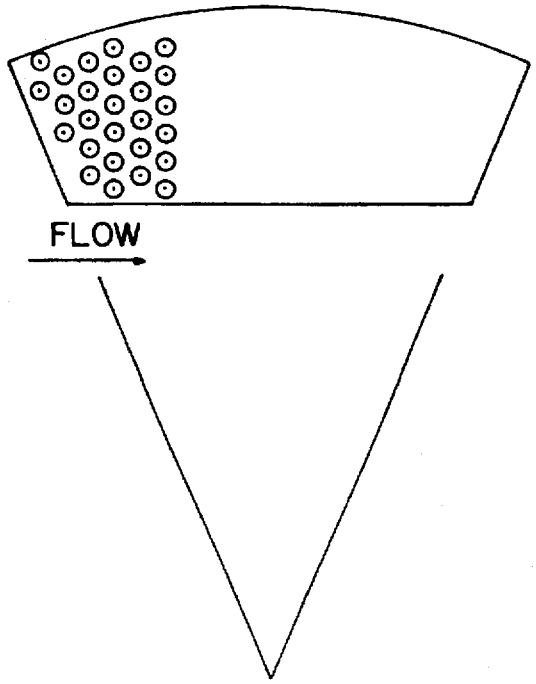
FIG. 5 is a view similar to FIG. 4 of a perforated spin vane according to the present invention.

Referring to the drawings in particular, wherein like numerals designate the same or functionally similar elements through the several drawings, FIG. 4 shows a known solid spin vane and FIG. 5 shows the vane with perforations according to the invention. A pattern of 9/16-inch diameter holes, sized and spaced as shown in FIG. 5, is typical for a spin vane that is 20 inches in length and 7½ inches in height. The dimensions given in FIG. 5 were extrapolated from a ⅙-scale model test with results illustrated in FIG. 3.

As shown in FIG. 5, the perforations, for example, occupy a leading portion of the vane, that is the upstream end of the vane, and ⅓ the length of the vane in the flow direction. The area of the perforations account 23% of the area of this leading section, with the leading section occupying 33% of the vane length in the flow direction.

Figure 1:
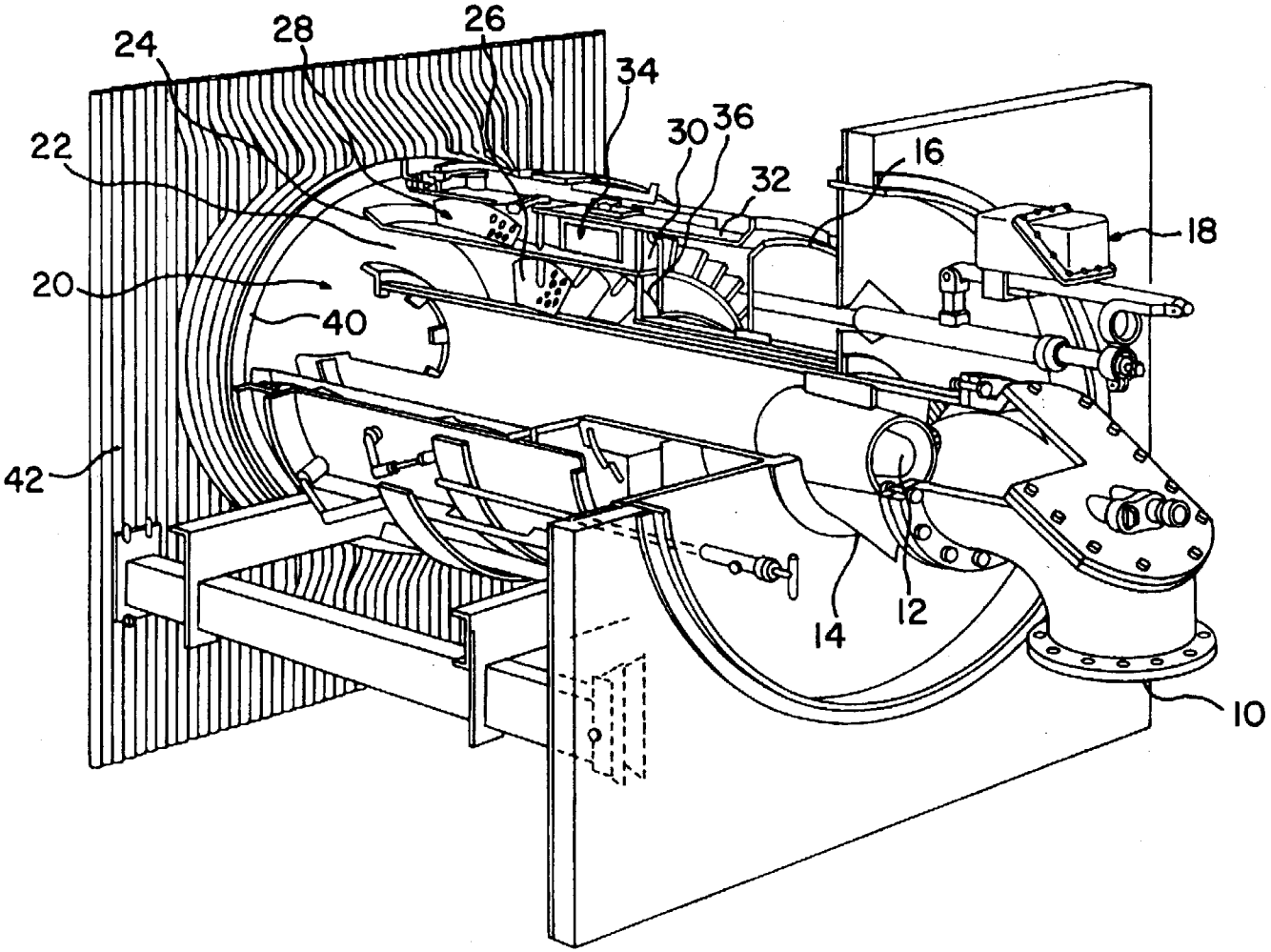
FIG. 1 is a perspective cutaway view of a DRB-XCL® burner, a registered trademark of The Babcock & Wilcox Company, to which the present invention has been applied.

FIG. 1 illustrates the present invention embodied within the spin vanes of a DRB-XCL® burner, a registered trademark of The Babcock & Wilcox Company. The burner includes a pulverized coal and primary air inlet 10 which receives pulverized coal and primary air and supplies it along a central conduit 14 containing a conical diffuser 12. A sliding disc 16 movable by sliding disc drive 18 are conventional features of the burner which, at the end of conduit 14, carries a flame stabilizer 20.

An inner air zone 22 is defined between the outer surface of conduit 14 and the inner surface of a cylindrical wall 24. A set of inner zone adjustable vanes 26 are circumferentially spaced around zone 22 and can be driven by known drive mechanisms to rotate between a position in which the plane of the vanes are in alignment with the flow direction, that is, are parallel to the axis of the zone 22, to a position where the vanes are at an angle of up to almost 90°, for closing off the zone. In operation, an angle of approximately 45° is practical for spinning or swirling the air in zone 22. Vanes 26, 28 are perforated according to the invention.

In likewise fashion, a second set of adjustable vanes 28 are circumferentially spaced around an outer zone 30 defined between cylinder 24 and an outer cylinder 32. Upstream of vanes 28, stationary vanes 34 may also be provided. An air measuring grid 36 of impact/suction probes, also called an air flow monitor (AFM) forms another conventional element of the burner of FIG. 1. The burner is mounted in front of a port 40 in a water or membrane wall 42 of a boiler.

Figure 2:
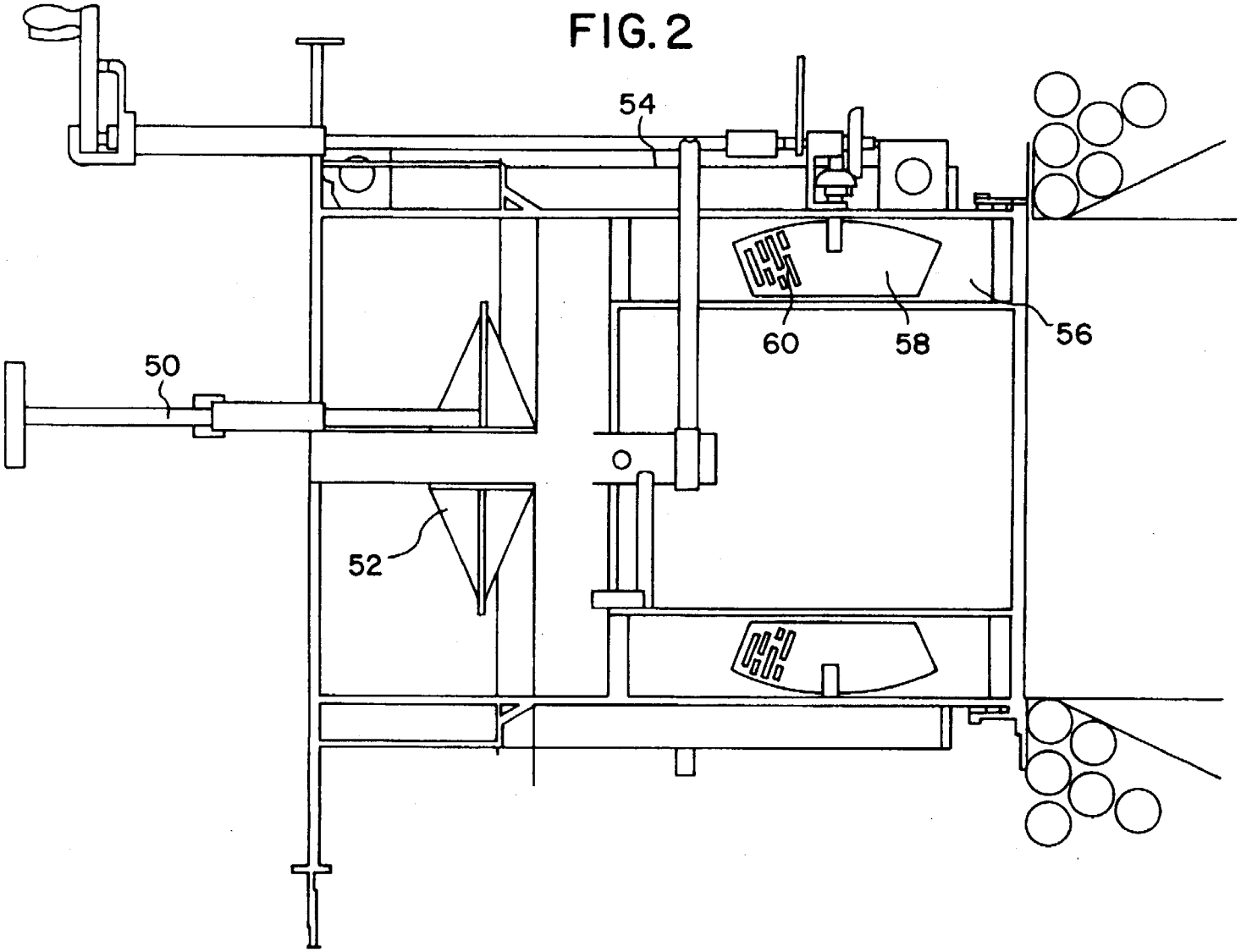
FIG. 2 is a sectional view of an $NO_x$ port assembly to which another embodiment of the invention has been applied.

FIG. 2 illustrates the invention utilized in a dual air zone $NO_x$ port assembly having an $NO_x$ port adjustor 50 and sliding air damper structure 52. An air flow monitor 54 is positioned downstream of the damper and an annular gas flow passage 56 contains a plurality of pivotable, circumferentially spaced spin vanes 58. Vanes 58 include a leading portion 60 containing spaced slots in accordance with another embodiment of the invention.

Returning to FIG. 4, one primary reason for the advantage of the present invention in reducing pressure drop, is the reduction or elimination of a "line of flow separation" which is the start of a recirculation zone shown by a curved line superimposed on the solid spin vane of FIG. 4.

Figure 6:
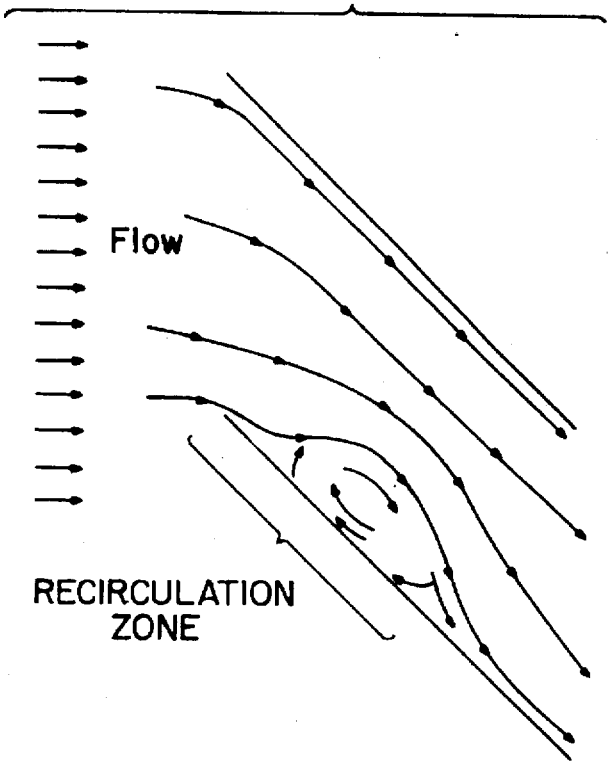
FIG. 6 PRIOR ART
FIG. 6 is a schematic representation showing how gas moving in a flow direction is diverted by the prior art solid vane.

As shown in FIG. 6, with the solid vanes at an angle to the flow direction, in this case 45°, a recirculation zone of gas flow occur behind each of the vanes, particularly behind the leading section of each solid vane.

Figure 7:
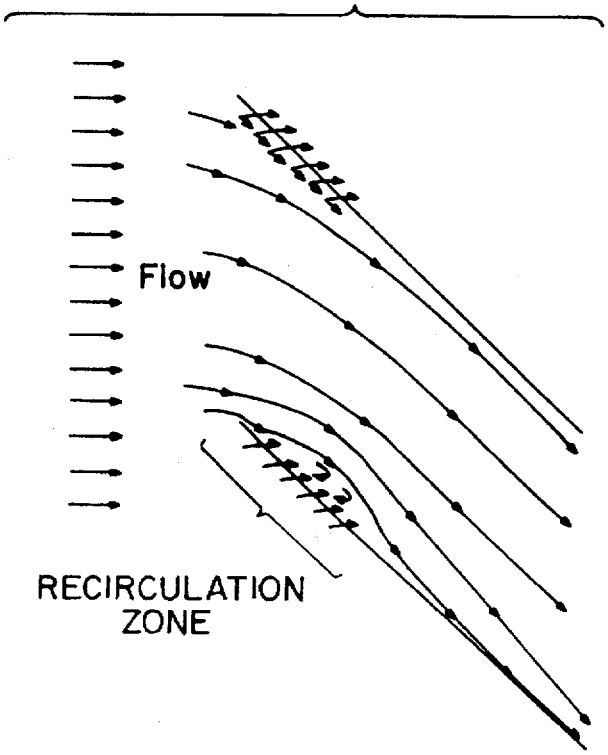
FIG. 7 is a view similar to FIG. 6 showing the flow pattern achieved through use of the present invention.

FIG. 7 illustrates how this recirculation zone is minimized or completely eliminated by adding perforations according to the present invention in the leading section of each otherwise solid vane, for allowing some gas to flow through this section of the vane, thus dispersing the recirculation zone.

Figure 8:
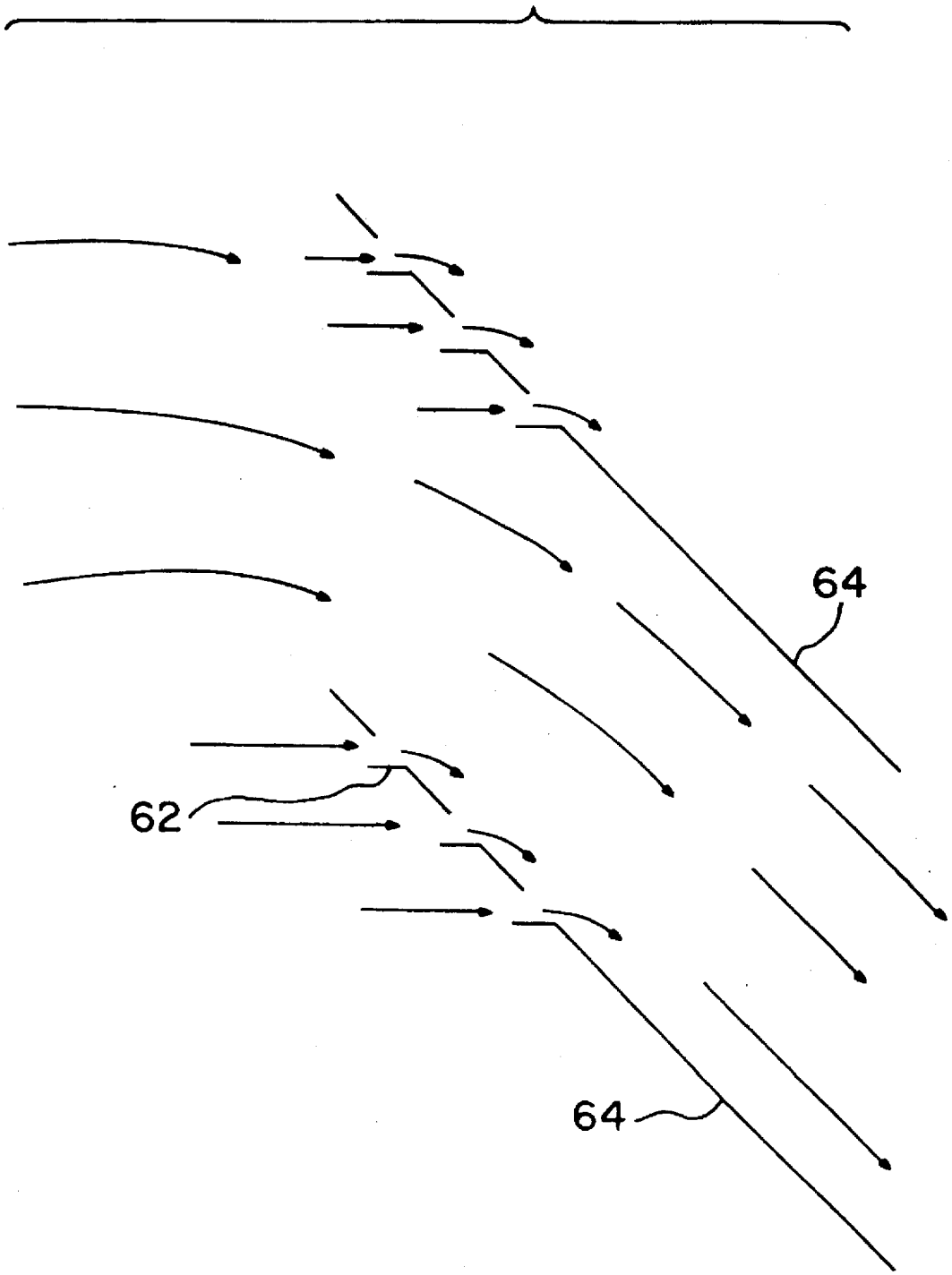
FIG. 8 is a view similar to FIG. 7 showing the flow pattern of another embodiment of the invention.

FIG. 8 illustrates another embodiment of the invention where each perforation includes a downstream, outwardly facing bent section 62 which further helps channel some of the flow gas through the perforation to virtually eliminate the recirculation zone. Each of the partially perforated spin vanes 64, have front sides facing the oncoming flow of gas and back sides facing away from the flow.

The bent sections 62 are flow guides which are associated with each perforation for advancing the purpose of the invention.

FIG. 3 illustrates the results of the ⅙ scale test conducted to verify the present invention.

The pressure drop characteristics are presented as a number of velocity heads (NVH), which is referenced to the velocity head in the annular flow passage. Presented in FIG. 3 is the NVH as a function of the Reynolds number range tested in the ⅙th-scale port for the solid and perforated vanes. The NVH is presented for the complete port (inlet+vanes+outlet), the (inlet+vanes), and the outlet. The pertinent results given in FIG. 3 are:

The NVH for the port is reduced with the perforated spin vanes. The reduction in NVH ranged from 10% to 16%, as given below.

| Vane | Test No. | Re. No. | Port NVH | % Reduction |
|---|---|---|---|---|
| Solid | SO4 | 29,182 | 2.82 | Base |
| Perforated | PO5 | 28,896 | 2.54 | 10% |
| Solid | SO2 | 66,200 | 3.78 | Base |
| Perforated | PO1 | 67,448 | 3.18 | 16% |
| Perforated | PO3 | 66,266 | 3.21 | 15% |
| Perforated | P10 | 66,080 | 3.23 | 15% |

For both the solid vane and the perforated vane, the NVH for the complete port is a function of Reynolds number, Re. Over the Reynolds number range of 30,000 to 65,000, the NVH increases as Reynolds number increases.

For the solid spin vane at a Reynolds number range of about 65,000 to 75,000, a discontinuity in the NVH relationship was found at a Reynolds number of about 70,000. This was due to a change or transition in the flow patterns. Experience indicates that the discontinuity does not exist in full-size burners or $NO_x$ ports operating at Reynolds numbers greater than the range tested in the ⅙th-scale model.

For both the solid and the perforated spin vanes, the NVH for the outlet was similar and a weak function of Reynolds number. This is a good indicator that the swirl characteristics exiting the passage of both the solid and the perforated vanes arrangements are similar.

To visualize and map the flow patterns on both the solid and the perforated vanes, a dyed mineral oil and a "wool tuft" were used. The flow patterns of FIGS. 6 and 7 resulted. Comparing the recirculation zones for the vanes, the size of the recirculation zone for the perforated vane decreased from that observed for the solid vane.

It was these qualitative visual results that helped in placing the holes in the solid vane. Because the size of the recirculation zone was reduced with the first attempt at a hole size and a pattern, no further configurations were evaluated to optimize the pressure drop reduction.

The apparent swirl of the airflow exiting from the spin vane passage was observed with the wool tuft. There was no noticeable change in the airflow exit angle with the perforated spin vanes as compared to that observed with the solid spin vanes.

While specific embodiments of the invention have been shown and described in detail to illustrate the application of the principles of the invention, it will be understood that the invention may be embodied otherwise without departing from such principles.

We claim:

1. A vane assembly for a dual air zone $NO_x$ port assembly, comprising:

means for defining an annular flow passage for gas moving in a flow direction;

at least one spin vane in the annular flow passage positionable at an angle to the flow direction, the spin vane being made of flat sheet material and having a leading portion which is perforated with a plurality of perforations, the perforations occupying approximately ⅓ of a length of the at least one spin vane in the flow direction; and means for rotating the at least one spin vane between approximately 0° and approximately 90° to the flow direction.

2. An assembly according to claim 1, wherein the perforations are circular.

3. An assembly according to claim 1, wherein the perforations are slots.

4. An assembly according to claim 1, including an outwardly bent projection at a downstream end of each perforation extending in a direction opposite to the flow direction.

5. An assembly according to claim 1, wherein the perforations occupy 23% of the total area of the leading portion of the vane.

6. A spin vane for positioning at an angle to a flow direction in a flow passage of a burner, the spin vane comprising a flat sheet material member having a leading section in the flow direction which is perforated with a plurality of perforations, the perforations occupying approximately ⅓ of a length of the spin vane in the flow direction.

7. A vane according to claim 6, wherein the perforations are circular.

8. A vane according to claim 6, wherein the perforations are slots.

9. A vane according to claim 6, including an outwardly bent projection at a downstream end of each perforation extending in a direction opposite to the flow direction.

10. A vane according to claim 7, wherein the perforations occupy from 23% of the total area of the leading portion of the vane.

11. A vane according to claim 6, including means for rotating the vane between approximately 0° and approximately 90° to the flow direction.

12. A burner arrangement for a boiler having means for defining a flow passage for combustion gas moving in a flow direction; means for supplying a fuel for burning with the combustion gas; at least one spin vane in the flow passage positionable at an angle to the flow direction, the spin vane being made of flat sheet material and having a leading section with respect to the flow direction which is perforated with a plurality of perforations, the perforations occupying approximately ⅓ of a length of the at least one spin vane in the flow direction; and means for rotating the at least one spin vane between approximately 0° and approximately 90° to the flow direction.

13. A arrangement according to claim 12, wherein the perforations are circular.

14. An arrangement according to claim 12, wherein the perforations are slots.

15. An arrangement according to claim 12, including an outwardly bent projection at a downstream end of each perforation extending in a direction opposite to the flow direction.

16. An arrangement according to claim 12, wherein the perforations occupy from 23% of the total area of the leading portion of the vane.

17. An arrangement according to claim 12, wherein the means for supplying fuel comprises a fuel plus primary air conduit for directing fuel and primary air through a central area along an axis of the flow passage, the flow passage being annular and being positioned around the conduit, the arrangement including a plurality of circumferentially spaced vanes in the flow passage.

* * * * *